US006666756B1

(12) United States Patent
Travis

(10) Patent No.: US 6,666,756 B1
(45) Date of Patent: Dec. 23, 2003

(54) WAFER CARRIER HEAD ASSEMBLY

(75) Inventor: Glenn W. Travis, Sunnyvale, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/540,603

(22) Filed: Mar. 31, 2000

(51) Int. Cl.[7] ..... B24B 5/00; B24B 29/00

(52) U.S. Cl. ..... 451/283; 451/287; 451/289; 451/388

(58) Field of Search ..... 451/285–291, 451/41, 388, 390, 397, 398, 402

(56) References Cited

U.S. PATENT DOCUMENTS

| | | | |
|---|---|---|---|
| 2,606,405 | A | 8/1952 | Ohl |
| 3,579,916 | A | 5/1971 | Boettcher |
| 3,631,634 | A | 1/1972 | Weber |
| 3,691,694 | A | 9/1972 | Goetz et al. |
| 3,708,921 | A | 1/1973 | Cronkhite et al. |
| 3,731,435 | A | 5/1973 | Boettcher et al. |
| 3,747,282 | A | 7/1973 | Katzke |
| 3,833,230 | A | 9/1974 | Noll |
| 3,886,693 | A | 6/1975 | Tajnafol et al. |
| 3,888,053 | A | 6/1975 | White et al. |
| 3,924,361 | A | 12/1975 | White et al. |
| 3,986,433 | A | 10/1976 | Walsh et al. |
| 4,009,539 | A | 3/1977 | Day |
| 4,020,600 | A | 5/1977 | Day |
| 4,098,031 | A | 7/1978 | Hartman |
| 4,132,037 | A | 1/1979 | Bonora |
| 4,141,180 | A | 2/1979 | Gill, Jr. et al. |
| 4,193,226 | A | 3/1980 | Gill, Jr. et al. |
| 4,194,324 | A | 3/1980 | Bonora et al. |
| 4,256,535 | A | 3/1981 | Banks |
| 4,270,316 | A | 6/1981 | Kramer et al. |

(List continued on next page.)

FOREIGN PATENT DOCUMENTS

| | | |
|---|---|---|
| EP | 0 284 343 A3 | 9/1988 |
| EP | 0 362 811 A3 | 4/1990 |
| EP | 0 589 433 A1 | 3/1994 |
| EP | 0 747 167 A2 | 12/1996 |
| EP | 0 768 148 A1 | 4/1997 |
| EP | 0 841 123 A1 | 5/1998 |
| JP | 55-157473 | 12/1980 |
| JP | 59-187456 | 10/1984 |
| JP | 63200965 | 8/1988 |
| JP | 63251166 | 10/1988 |
| JP | 6-91522 | 10/1994 |

OTHER PUBLICATIONS

Copy of International Search Report for PCT/US01/09878 dated Sep. 20, 2001.

Copy of co–pending U.S. application Ser. No. 09/475,543 filed Dec. 30, 1999.

Copy of claims for co–pending U.S. application Ser. No. 09/672,605 filed Sep. 29, 2000.

(List continued on next page.)

*Primary Examiner*—M. Rachuba

(74) *Attorney, Agent, or Firm*—Brinks Hofer Gilson & Lione

(57) ABSTRACT

A wafer carrier head assembly for holding a wafer in chemical mechanical planarization applications is dis;losed that includes a downwardly protruding wafer retaining ring that moves independent of the wafer carrier head and retains an edge of the wafer on said polishing surface. An adjustable wafer holding mechanism that applies one of a uniform downward force and a uniform upward force to the wafer is also included. Application of the upward force allows the wafer holding mechanism to retain and transport the wafer to a polishing surface. Application of the downward force allows the wafer holding mechanism to retain the wafer on the polishing surface and allows the wafer to be uniformly polished. The wafer carrier head assembly herein disclosed is also configured to pivotally accommodate changes in parallelism between the wafer and the polishing surface when the wafer is being polished.

21 Claims, 5 Drawing Sheets

U.S. PATENT DOCUMENTS

| | | | | | |
|---|---|---|---|---|---|
| 4,283,242 | A | | 8/1981 | Regler et al. | |
| 4,313,284 | A | | 2/1982 | Walsh | |
| 4,316,757 | A | | 2/1982 | Walsh | |
| 4,373,991 | A | | 2/1983 | Banks | |
| 4,450,652 | A | | 5/1984 | Walsh | |
| 4,459,785 | A | | 7/1984 | Zimmer | |
| 4,502,252 | A | | 3/1985 | Iwabuchi | |
| 4,512,113 | A | | 4/1985 | Budinger | |
| 4,519,168 | A | | 5/1985 | Cesna | |
| 4,680,893 | A | | 7/1987 | Cronkhite et al. | |
| 4,693,036 | A | | 9/1987 | Mori | |
| 4,711,610 | A | | 12/1987 | Riehl | |
| 4,753,049 | A | | 6/1988 | Mori | |
| 4,811,522 | A | | 3/1989 | Gill, Jr. | |
| 4,897,966 | A | | 2/1990 | Takahashi | |
| 4,918,869 | A | | 4/1990 | Kitta | |
| 4,918,870 | A | | 4/1990 | Torbert et al. | |
| 4,944,119 | A | | 7/1990 | Gill, Jr. et al. | |
| 5,035,087 | A | | 7/1991 | Nishiguchi et al. | |
| 5,036,630 | A | | 8/1991 | Kaanta et al. | |
| 5,081,795 | A | | 1/1992 | Tanaka et al. | |
| 5,095,661 | A | | 3/1992 | Gill, Jr. et al. | |
| 5,121,572 | A | | 6/1992 | Hilscher | |
| 5,193,316 | A | | 3/1993 | Olmstead | |
| 5,205,082 | A | | 4/1993 | Shendon et al. | |
| 5,230,184 | A | | 7/1993 | Bukhman | |
| 5,238,354 | A | | 8/1993 | Volovich | |
| 5,257,478 | A | | 11/1993 | Hyde et al. | |
| 5,297,361 | A | | 3/1994 | Baldy et al. | |
| 5,329,732 | A | | 7/1994 | Karlsrud et al. | |
| 5,335,453 | A | | 8/1994 | Baldy et al. | |
| 5,361,545 | A | | 11/1994 | Nakamura | |
| 5,377,451 | A | | 1/1995 | Leoni et al. | |
| 5,398,459 | A | | 3/1995 | Okumura et al. | |
| 5,404,678 | A | | 4/1995 | Hasegawa | |
| 5,421,769 | A | | 6/1995 | Schultz et al. | |
| 5,423,558 | A | | 6/1995 | Koeth et al. | |
| 5,423,716 | A | | 6/1995 | Strasbaugh | |
| 5,441,444 | A | | 8/1995 | Nakajima | |
| 5,443,416 | A | | 8/1995 | Volodarsky | |
| 5,449,316 | A | | 9/1995 | Strasbaugh | |
| 5,476,414 | A | | 12/1995 | Hirose et al. | |
| 5,486,129 | A | | 1/1996 | Sandhu et al. | |
| 5,507,614 | A | | 4/1996 | Leonov et al. | |
| 5,527,209 | A | | 6/1996 | Volodarsky et al. | |
| 5,558,568 | A | | 9/1996 | Talieh et al. | |
| 5,562,524 | A | | 10/1996 | Gill, Jr. | |
| 5,567,199 | A | | 10/1996 | Huber et al. | |
| 5,571,044 | A | | 11/1996 | Bolandi et al. | |
| 5,575,706 | A | | 11/1996 | Tsai et al. | |
| 5,575,707 | A | | 11/1996 | Talieh et al. | |
| 5,582,534 | A | | 12/1996 | Shendon et al. | |
| 5,584,746 | A | | 12/1996 | Tanaka et al. | |
| 5,584,751 | A | * | 12/1996 | Kobayashi et al. | 451/288 |
| 5,593,344 | A | | 1/1997 | Weldon et al. | |
| 5,607,341 | A | | 3/1997 | Leach | |
| 5,624,299 | A | | 4/1997 | Shendon | |
| 5,635,083 | A | | 6/1997 | Breivogel et al. | |
| 5,681,215 | A | | 10/1997 | Sherwood et al. | |
| 5,692,947 | A | | 12/1997 | Talieh et al. | |
| 5,716,258 | A | * | 2/1998 | Metcalf | 451/41 |
| 5,762,544 | A | | 6/1998 | Zuniga et al. | |
| 5,803,799 | A | | 9/1998 | Volodarsky et al. | |
| 5,857,899 | A | | 1/1999 | Volodarsky et al. | |
| 5,951,373 | A | | 9/1999 | Shendon et al. | |
| 5,993,302 | A | * | 11/1999 | Chen et al. | 451/285 |
| 6,024,630 | A | * | 2/2000 | Shendon et al. | 451/41 |
| 6,089,961 | A | * | 7/2000 | Cesna et al. | 451/285 |
| 6,206,768 | B1 | * | 3/2001 | Quek | 451/287 |
| 6,244,946 | B1 | | 6/2001 | Volodarsky | |

OTHER PUBLICATIONS

Copy of claims for co–pending U.S. application Ser. No. 09/843,323 filed Apr. 25, 2001.

Copy of claims for co–pending U.S. application Ser. No. 09/745,653 filed Dec. 21, 2000.

Abstract for DE 2442081 A., *Two Disc Lapping Machine*, Mar. 18, 1975.

Abstract, Hause, Jr. R. et al.: *Lapping Machine With Soft Carriers*; Jul. 1980.

U.S. application Ser. No. 09/475,543, Young et al., filed Dec. 30, 1999.

* cited by examiner

WAFER CARRIER HEAD ASSEMBLY

FIELD OF THE INVENTION

The present invention relates to a carrier assembly for releasably holding a thin material. More particularly, the present invention relates to a wafer carrier assembly for use in chemical mechanical polishing/planarization of semiconductor wafers.

BACKGROUND

Semiconductor wafers are commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that must be smoothed out before generating the next circuit layer.

Chemical mechanical planarization (CMP) techniques are used to planarize the raw wafer and each layer of circuitry added. Available CMP systems, commonly called wafer polishers, often use a rotating wafer carrier head that brings the wafer into contact with a polishing pad rotating in the plane of the wafer surface to be planarized. A chemical polishing agent or slurry containing microabrasives is applied to the polishing pad to polish the wafer. The wafer carrier head then presses the wafer against the rotating polishing pad and is rotated to polish and planarize the wafer. The mechanical force for polishing is derived from the rotating table speed and the downward force on the wafer carrier head. The chemical slurry is constantly transferred under the wafer carrier head. Rotation of the wafer carrier head helps in the slurry delivery as well in averaging the polishing rates across the substrate surface.

Another technique for performing CMP to obtain a more uniform polishing rate is the use of a linear polisher. Instead of a rotating pad, a moving belt is used to linearly move the pad across the wafer surface. The wafer is still rotated to average out the local variations. An example of a linear polisher is the TERES™ polisher available from Lam Research Corporation of Fremont, Calif.

With either type of polisher (linear or rotary), the wafer carrier head is an important component of the polishing tool. The wafer carrier head provides means for holding and supporting the wafer, rotating the wafer, and transmitting the polishing force to engage the wafer against the pad. The wafer carrier head is coupled to a rotating mechanism that also applies a pressure to the wafer so that the wafer can rotate while being pressed against a polishing surface.

In conventional wafer carrier head designs, it is customary to employ the use of a wafer mounting pad or carrier film that is adhesively bonded to a wafer mounting plate. This film serves to absorb or conform to surface irregularities on the back side of the wafer and, due to its high coefficient of friction, prevent the wafer from rotating inside the wafer carrier head as the wafer carrier head is being rotated during the polishing process. However, these designs also require that the film be replaced following a set number of polishing cycles.

In designs that employ a wafer mounting plate and a wafer mounting pad or film, the wafer is held by the wafer carrier head via a series of holes in the mounting pad. The holes allow passage of vacuum forces to the side of the wafer that is in contact with the mounting pad. However, this design has the disadvantage of drawing polishing slurry back through the holes and up into the vacuum lines, necessitating a flush system to periodically flush out the slurry.

Other designs employ the use of an inflatable elastomeric membrane to hold the wafer as it is being transferred to a polishing surface. Once the wafer carrier head is lowered to a polishing surface, the membrane inflates and applies a downward force onto the wafer so that the wafer contacts the polishing surface. These designs also employ a fixed non-adjustable retaining ring. The carrier head is lowered so that the retaining ring contacts the polishing surface. The retaining ring then prevents the wafer from slipping out from under the carrier head as the membrane is being inflated so that the wafer contacts the polishing surface. However, this design has the disadvantage of requiring precise timing between contacting the ring to the polishing surface and inflating the membrane. If the membrane inflates before the retaining ring contacts the polishing surface, the wafer may extend beyond the retaining ring. The wafer will then lose its peripheral containment and will slip out from under the carrier head when it reacts to the frictional forced introduced by contacting the moving polishing surface.

Edge exclusion is another disadvantage of wafer carrier head designs that employ an inflatable membrane. Edge exclusion categorically is a portion of the wafer edge that does not receive the same degree of polishing action as the balance of the wafer. The result is a reduction of usable area for product production.

Wafer carrier heads should be capable of gimballing in order to accommodate changes in parallelism between the carrier head and the polishing surface. Many wafer carrier heads gimbal through the use of a mechanical gimbal. However, mechanical gimbals have the disadvantage of causing a moment arm to form whose length is equal to the distance between the mechanical gimbal point and the polishing surface. This moment arm in turn aggravates a problem known as "dig in", a problem common to carrier heads that gimbal. Dig in occurs when the wafer mounting surface digs into the leading edge of the wafer and causes a higher removal rate at the wafer edge than the remainder of the wafer. The moment arm associated with mechanical gimbals multiplies this tendency, and the resultant "dig in" is directly proportionate to the length of the moment arm.

BRIEF SUMMARY

To alleviate the disadvantages of the prior art, a carrier assembly for releasably holding a wafer is provided herein. According to a first aspect of the invention, the carrier assembly includes a primary housing having an adjustable retaining ring that protrudes downwardly from the primary housing. A secondary housing, fixed to the primary housing, has a wafer holding mechanism positioned in an area surrounding the circumference of the retaining ring. The retaining ring is movable with respect to the primary housing. The retaining ring moves independently of the wafer holding mechanism, and retains an edge of the wafer on the polishing surface when the wafer is lowered onto the polishing surface.

In another aspect of the invention the carrier assembly includes a primary housing. The primary housing has an adjustable wafer retaining mechanism that is configured to retain an edge of a wafer on a polishing surface when the wafer is being lowered onto the polishing surface. A secondary housing is fixed to the primary housing and has an adjustable wafer holding mechanism. The wafer holding mechanism is configured to apply one of a downward force and an upward force to the wafer to retain and transport the wafer to and from the polishing surface and to retain the wafer on the polishing surface. The wafer holding mechanism provides an adjustable and controllable downward force on the wafer so that the wafer is uniformly polished when the wafer holding mechanism is retaining the wafer on the polishing surface.

In another aspect of the invention the carrier assembly includes a primary housing having a vertically adjustable wafer retaining mechanism. The wafer retaining mechanism retains the edge of a wafer on a polishing surface when the wafer is being lowered onto the polishing surface. A secondary housing is fixed to the primary housing and has a vertically adjustable wafer holding mechanism that retains and transports a wafer to and from a polishing surface and retains the wafer on the polishing surface. The wafer retaining mechanism and the wafer holding mechanism are configured to pivotally accommodate changes in parallelism between the wafer and the polishing surface when the wafer is being polished by the polishing surface.

According to another aspect of the invention, a method for handling a wafer to be polished includes the steps of receiving the wafer at a wafer carrier head so that the wafer contacts the wafer carrier head. A uniform upward force is applied from the wafer carrier head to retain the wafer. The wafer carrier head is then transported to a polishing surface, and a protruding retaining mechanism is lowered from the wafer carrier head onto the polishing surface so that the retaining mechanism contacts the polishing surface. A uniform downward force is then applied onto the wafer. The wafer retaining mechanism is then raised, and the wafer is polished.

The foregoing and other features and advantages of the invention will become further apparent from the following detailed description of the presently preferred embodiments, read in conjunction with the accompanying drawings.

DETAILED DESCRIPTION OF THE PRESENTLY PREFERRED EMBODIMENTS

Figure 1:
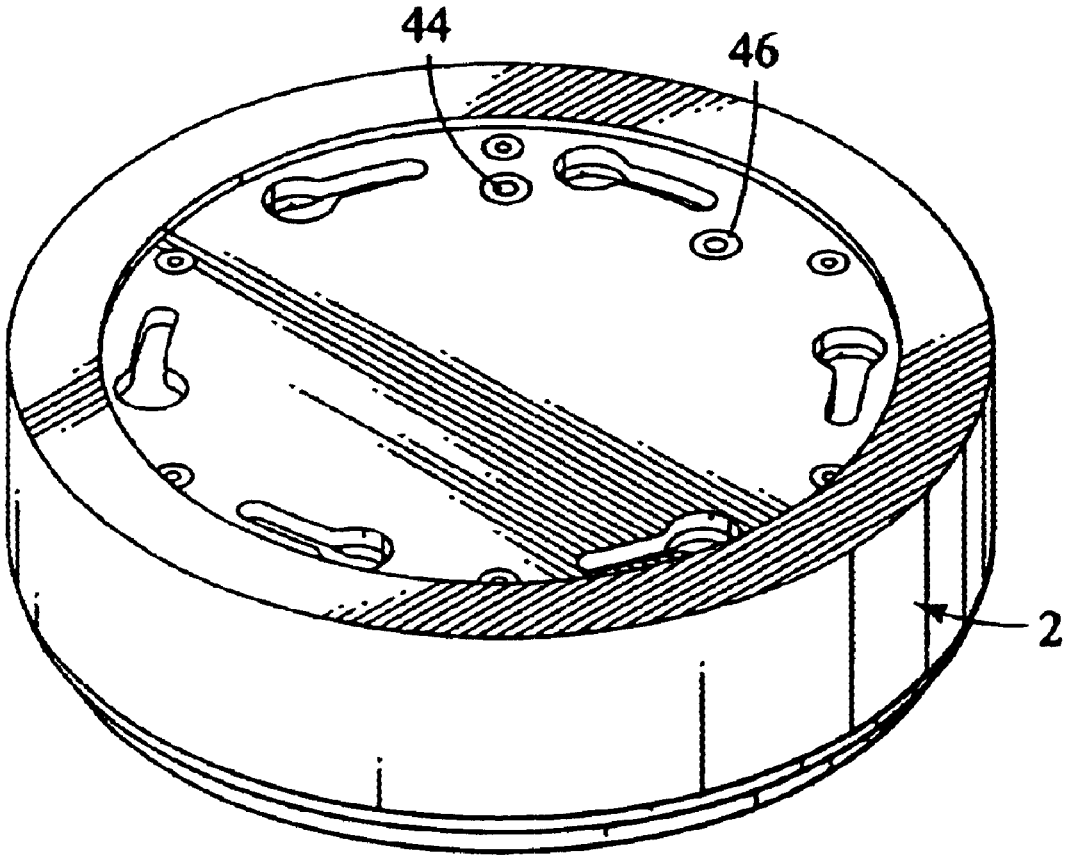
FIG. 1 is a perspective view of a preferred embodiment of the present invention.
Figure 2:
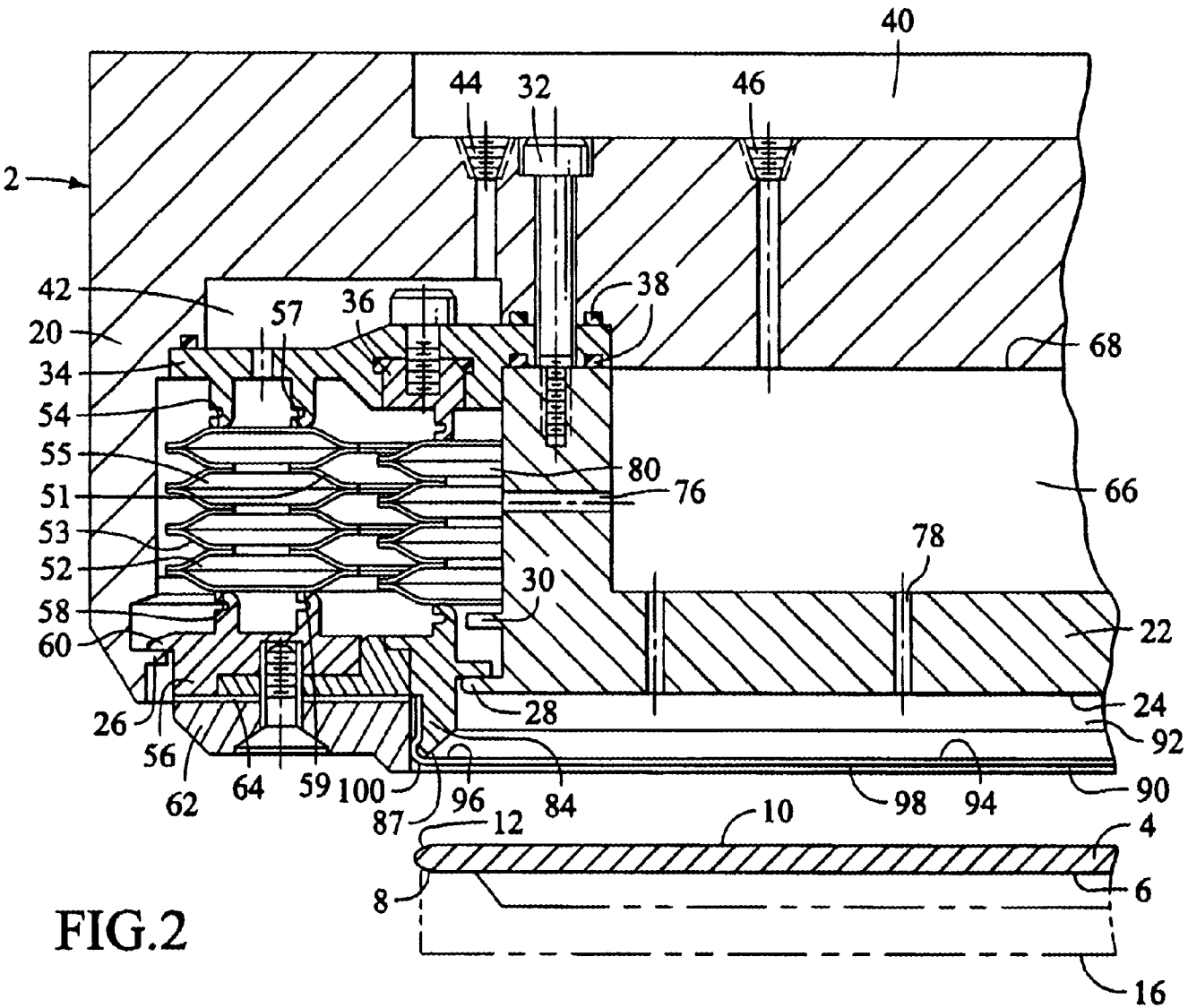
FIG. 2 is a front sectional view of a preferred embodiment of FIG. 1 showing a wafer being supported by the wafer handling mechanism below the wafer carrier head.
Figure 4:
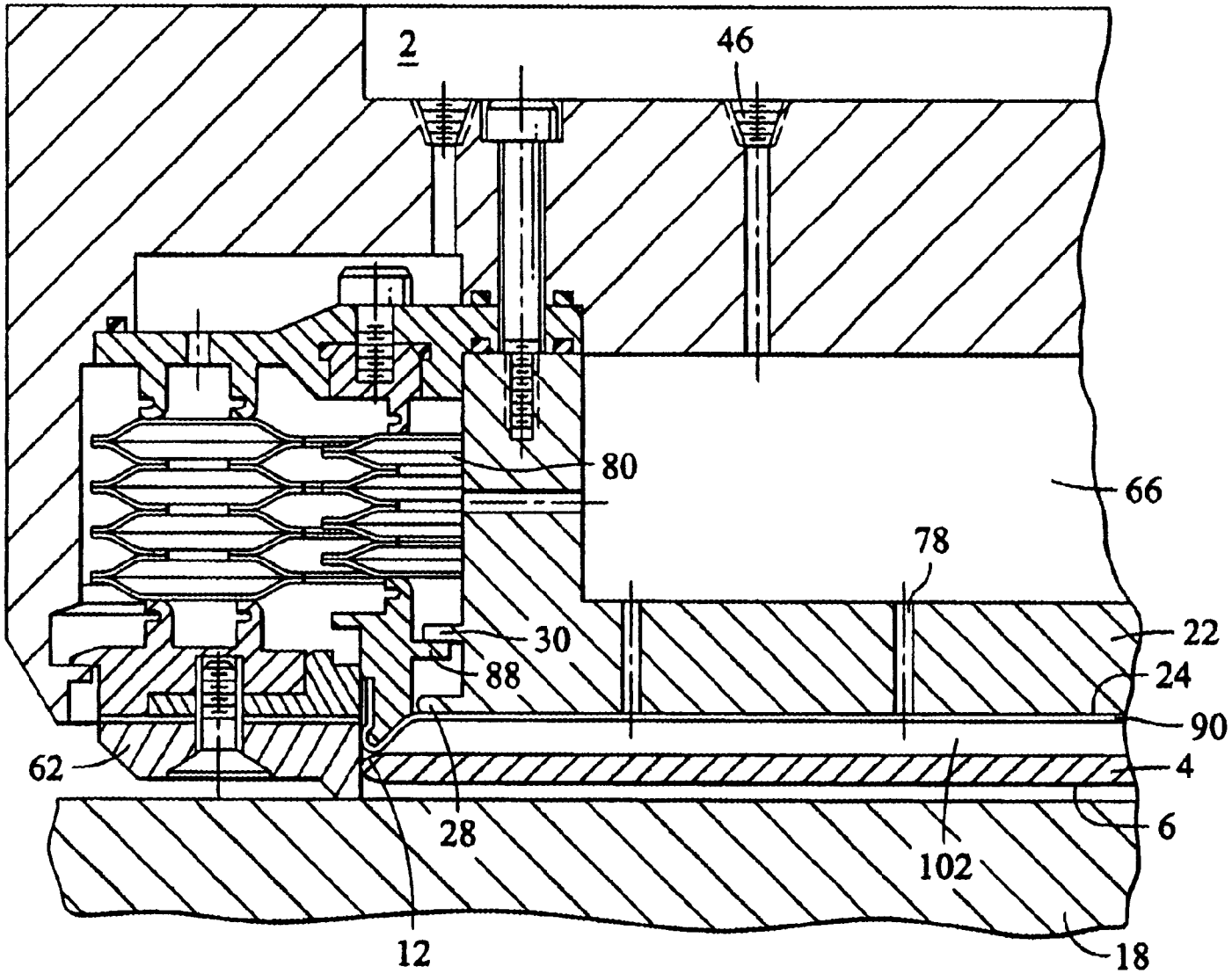
FIG. 4 is a front sectional view of a preferred embodiment of FIG. 1 showing the wafer carrier head lowered onto a polishing surface.

FIGS. 1 & 2 illustrate a preferred embodiment of the wafer carrier head 2. A novel wafer carrier head 2 to perform chemical-mechanical polishing (CMP) on a wafer 4 that addresses the drawbacks of the prior art discussed above is described below. The wafer 4 has a downward side 6 having an outer part 8 and an upward side 10 having an outer part 12 that opposes the outer part 8. As will be more fully described below, in order for the wafer 4 to be held on a polishing surface 18, the outer parts 8, 12 of the wafer 4 receive pressure from an inner bellows assembly 80, as opposed to the remainder of the wafer 4 that does not receive pressure from the inner bellows assembly 80. A wafer handling mechanism 16, which may be any of a number of commercially available wafer handling robots or other mechanical device suitable for use in transporting wafers, will support the downward side 6 of the wafer 4 and bring it over to the wafer carrier head 2. The wafer carrier head 2 will retrieve the wafer 4 from the wafer handling mechanism 16 via the upward side 10 and will transport the wafer 4 to a polishing surface 18 (FIG. 4).

The wafer carrier head 2 will then lower the wafer 4 onto the polishing surface 18 so that the downward side 6 can be polished. Upon completion of the polishing, the wafer carrier head 2 will remove the wafer 4 from the polishing surface 18 and transport it to be unloaded. The wafer carrier head 2 will then release the polished wafer 4 back onto the wafer handling mechanism 16. Further detail about the wafer carrier head 2 and its operation is given below. An example of a suitable wafer polisher, having a suitable wafer polishing surface, is the TERES™ CMP System available from Lam Research Corporation of Fremont, Calif.

Figure 3:
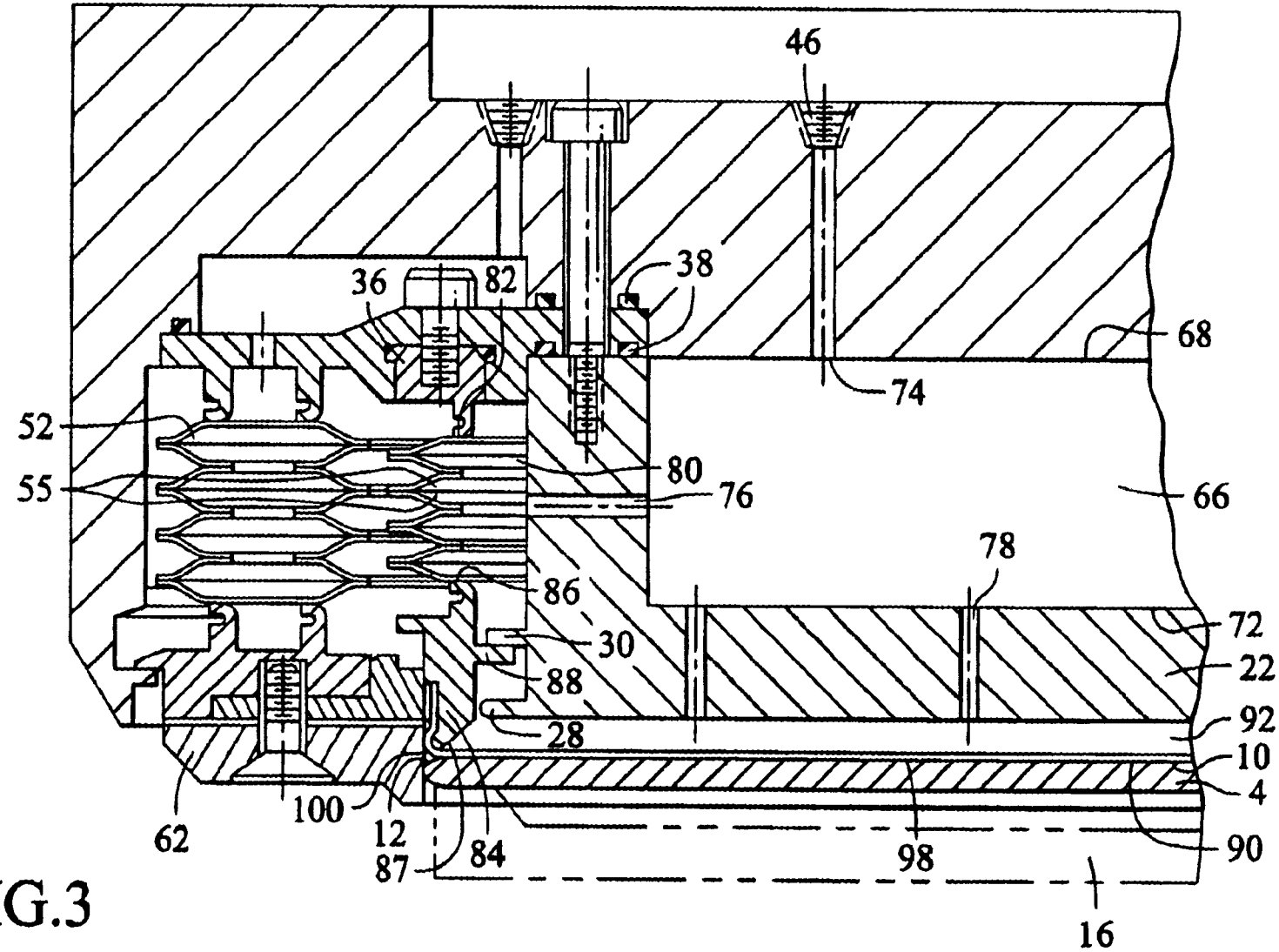
FIG. 3 is a front sectional view of a preferred embodiment of FIG. 1 showing the wafer being supported by the wafer handling mechanism and contacting the wafer carrier head.

Referring to FIGS. 2 & 3, an inner housing 22 having a downwardly facing wall 24 and an outer housing 20 are included. The outer housing 20 includes an outer housing flange 26 and the inner housing 22 includes a lower flange 28 and an upper flange 30. Fasteners 32, preferably bolts, hold the inner housing 22, the outer housing 20, and an outer bellows plate 34 stationary with respect to each other. The fasteners 32 also attach an inner bellows plate 36 to the outer bellows plate 34. In the preferred embodiment there are at least eight fasteners 32, but a different number of fasteners can be used in other configurations. Seals 38 are provided to seal the areas where the fasteners 32 enter the inner housing 22, the outer housing 20, the outer bellows plate 34, and the inner bellows plate 36. In a preferred embodiment the seals 38 used are o-rings.

The outer housing 20 also includes a receiving mechanism 40, a cavity 42, an outer port 44, and an inner port 46. The receiving mechanism 40 receives a connection mechanism 48 for attaching to a spindle (not shown). The spindle applies downward and rotational forces to the wafer carrier head 2 during operation. The spindle and wafer carrier head 2 releasably attach to one another with respective male and female tool changer mechanisms.

The cavity 42 is preferably a recess in the outer housing 20 that allows positive pressure and vacuum forces to pass through to the outer port 44. The cavity 42 also provides space for the fasteners 32 that affix the inner bellows plate 36 to the outer bellows plate 34.

The inner port 46 and the outer port 44 each receive positive pressure and vacuum forces. Preferably, the positive pressure and vacuum forces are pneumatic. The inner port 46 and the outer port 44 operate independently of each other. One port can receive a positive pressure and at the same time a vacuum can be applied to the other port. The positive pressure and vacuum forces are both variable and may be provided by any of a number of pressure or vacuum generating devices.

An outer bellows assembly 52 is attached to the outer port 44 and receives the positive pressure and vacuum from the outer port 44. Preferably, the outer bellows assembly 52 is made up of a small bellows 51 and a large bellows 53 that are concentric with each other. Small bellows 51 and large bellows 53 are each made by welding together formed rings 55 until the length desired for the small bellows 51 and large bellows 53 is achieved. An upper portion 57 of small bellows 51 and an upper portion 54 of large bellows 53 are fixed to outer bellows plate 34 by being welded to outer bellows plate 34. Similarly, a bottom portion 59 of small bellows 51 and a bottom portion 58 of large bellows 53 are fixed to a lower ring 56 by being welded to lower ring 56. The outer bellows assembly 52 is preferably flexible and vertically extends and contracts in a direction substantially perpendicular to the upward side 10 of the wafer 4 when the positive pressure and vacuum, respectively, are applied to the outer port 44.

The lower ring 56 moves in a substantially vertical direction with the outer bellows assembly 52 when the outer bellows assembly 52 is extending and contracting. A lower ring flange 60 is included with the lower ring 56 and enters into and out of contact with the outer housing flange 26. In a preferred embodiment, the outer housing flange 26 limits the vertical distance that the outer bellows assembly 52 can extend. When the lower ring flange 60, which along with the lower ring 56 moves with the outer bellows assembly 52, comes into contact with the outer housing flange 26 the outer bellows assembly 52 cannot extend any further.

A wafer retaining ring 62 is attached to the lower ring 56 and protrudes from the lower ring 56 in a downward direction substantially perpendicular to the upward side 10 of the wafer 4. The retaining ring 62 is preferably made from a plastic material and prevents the wafer 4 from separating from the wafer carrier head 2 as it is being lowered to contact the polishing surface 18. The initial amount that the retaining ring 62 protrudes downwardly from the lower ring 56 is adjustable. In one embodiment, shims 64 may be placed between the lower ring 56 and the retaining ring 62 until the desired amount of protrusion is attained. Preferably, the shims are constructed from a Mylar material. The retaining ring 62 moves with the outer bellows assembly 52 and the lower ring 56, and the outer housing flange 26 and lower ring flange 60 also limit the vertical distance the retaining ring 62 can travel.

An inner port chamber 66 is preferably connected to, and in fluid communication with, the inner port 46 and receives the positive pressure and vacuum forces from the inner port 46. The inner port chamber 66 includes a top member 68, side members 70, and a bottom member 72. The inner port 46 is preferably in communication with the inner port chamber 66 via a passage 74 defined by the top member 68 of the inner port chamber 66. In a preferred embodiment, a side passage 76 extends from the side member 70 and at least two lower passages 78 extend from the bottom member 72, though in other embodiments a different number of side passages 76 and lower passages 78 can also be used.

The side passage 76 connects the inner port chamber 66 to an inner bellows assembly 80 and allows the positive pressure or vacuum forces to travel from the inner port chamber 66 to the inner bellows assembly 80. In a preferred embodiment, the inner bellows assembly 80 is oriented and substantially perpendicular to plane of the wafer 4. The inner bellows assembly 80 is made by welding together formed rings 55 until the length desired for the inner bellows assembly 80 is achieved. An upper end 82 of the inner bellows assembly 80 is welded to the inner bellows plate 36 and a bottom portion 86 of the inner bellows assembly 80 is welded to an inner ring 84. The inner bellows assembly 80 is flexible, and vertically extends and contracts in a direction substantially perpendicular to the upward side 10 of the wafer 4 when the positive pressure and vacuum, respectively, travel from the inner port 46 and through the inner port chamber 66 and side passage 76.

The inner ring 84 preferably includes a downwardly facing bottom surface 87 and an inner ring flange 88. The inner ring 84 extends and contracts with the inner bellows assembly 80. In a preferred embodiment, the upper flange 30 and lower flange 28 limit the vertical distance that the inner bellows assembly 80 and the inner ring 84 can extend or contract. When the inner ring flange 88 comes into contact with the lower flange 28, the inner bellows assembly 80 and inner ring 84 cannot extend any further. Likewise, when the inner ring flange 88 comes into contact with the upper flange 30, the inner bellows assembly 80 and inner ring 84 cannot contract any further.

Alternatives to the interaction between the inner ring flange 88 and the upper flange 30 and the lower flange 28 discussed above are also contemplated. For example, the inner housing 22 can include an inner housing flange and the inner ring 84 can have an upper flange and a lower flange. Contact by the upper flange on the lower ring with the inner housing flange would limit the distance the inner ring 84 and inner bellows assembly 80 could vertically extend. Likewise, contact by the lower flange on the lower ring with the inner housing flange would limit the distance the inner ring 84 and inner bellows assembly 80 could vertically contract. In other embodiments, the flanges could be discontinuous or staggered around the circumference of inner ring 84 and inner housing 22.

The lower passages 78 of the inner port chamber 66 allow the positive pressure and vacuum forces from the inner port 46 to be applied to a membrane 90 and a gap 92. The membrane 90 includes a top face 94 having an outer side 96 and a bottom face 98 having an outer side 100 that opposes the outer side 96. The outer side 96 of the top face 94 is attached to and covers the downwardly facing bottom surface 87 of the inner ring 84. In a preferred embodiment, the outer side 96 is adhesively bonded to the bottom surface 87 of the inner ring 84 and extends and contracts with the inner ring 84 and inner bellows assembly 80. The membrane is preferably elastomeric and deformable. The gap 92 is formed between the top face 94 of the membrane and the downwardly facing wall 24 of the inner housing 22 when the membrane 90 is in a non-deformed state. The gap 92 is eliminated when the vacuum force is applied to the inner port 46 and the top face 94 of the membrane 90 seals up against the downwardly facing wall 24 of the inner housing 22.

The operation of the wafer carrier head 2 embodiments set forth above is now described. To first load a wafer 4 onto the wafer carrier head 2 the wafer handling mechanism 16, supporting the downward side 6 of the wafer 4, transports the wafer 4 and aligns it with the inside diameter of the retaining ring 62. A positive pressure is applied to the outer bellows assembly 52 and causes the outer bellows assembly 52 to extend until the lower ring flange 60 on the lower ring 56 contacts the outer housing flange 26. No positive pressure or vacuum is applied from the inner port 46 to the inner bellows assembly 80.

With the positive pressure still applied to the outer bellows assembly 52, the wafer handling mechanism 16 raises the wafer 4 upward until the upward side 10 of the wafer 4 contacts the membrane 90. The wafer handling mechanism 16 pushes the wafer 4 in an upwardly direction until the inner ring flange 88 contacts the upper flange 30 on the inner housing 22. The upward force exerted by the wafer handling mechanism 16 against the wafer 4 results in a sealing action between the outer part 12 of the upward side 10 of the wafer 4 and the outer side 100 of the bottom face 98 of the membrane 90.

While the positive pressure is still being applied to the outer bellows assembly 52 and with the wafer handling mechanism 16 exerting an upward force, a vacuum is introduced at the inner port 46. The vacuum enters the inner port chamber 66 and, via the lower passages 78, travels into the gap 92. The vacuum causes the inner bellows assembly 80 to contract and exerts an upward force on the inner ring 84. This causes the inner ring flange 88 to maintain contact with the upper flange 30 on the inner housing 22.

As shown in FIG. 4, the vacuum in the gap 92 (FIG. 3) deforms the membrane 90 and draws it up and against the downwardly facing wall 24 of the inner housing 22, eliminating the gap 92. Since the outer part 12 of the wafer 4 is sealed against the membrane 90, a secondary vacuum 102 results between the remainder of the membrane 90 and the remainder of the wafer 4, holding the wafer 4 in place. The wafer handling mechanism 16 is then removed and the wafer carrier head 2 is moved to a polishing area and is positioned above the polishing surface 18.

Figure 5:
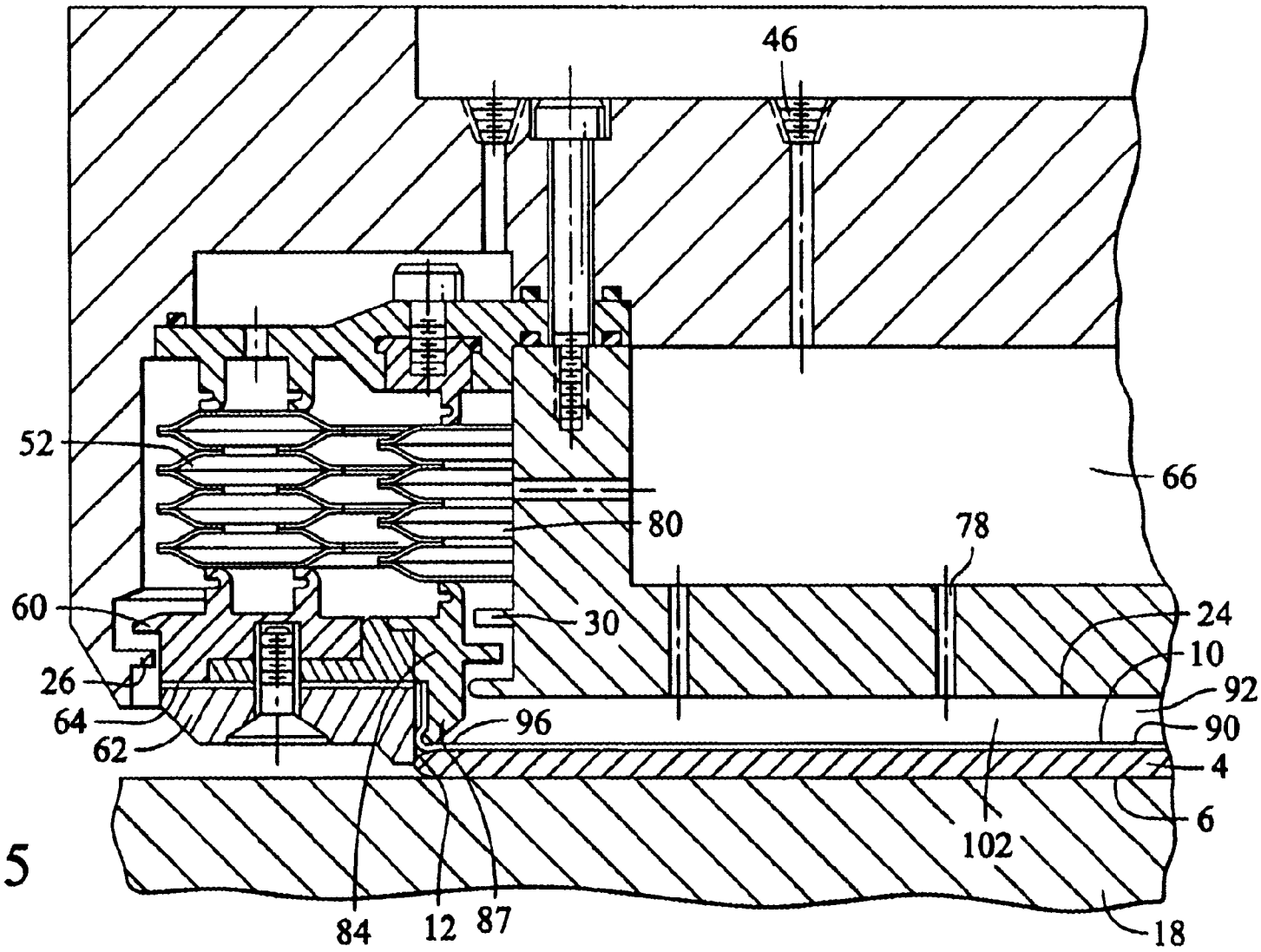
FIG. 5 is a front sectional view of a preferred embodiment of FIG. 1 showing a wafer being polished by the polishing surface and being retained by the wafer carrier head.

The wafer carrier head 2 is lowered to a pre-determined position that brings the retaining ring 62 into contact with the polishing surface 18. With the retaining ring 62 bearing against the polishing surface 18, the vacuum is removed and a positive pressure is instead applied to the inner bellows assembly 80. As shown in FIG. 5, the inner bellows assembly 80 extends and causes the upper flange 30 and inner ring flange 88 to come out of contact with each other. The positive pressure eliminates the secondary vacuum 102 and causes the membrane 90 to return to its non-deformed state. The upward side 10 of the wafer 4 is no longer in contact with the downwardly facing wall 24. The wafer 4 is moved in a downwardly direction until the downward side 6 contacts the polishing surface 18. The positive pressure causes the membrane 90 to exert a uniform downward force onto the wafer 4.

Once the positive pressure causes the downward side 6 of the wafer to contact the polishing surface 18, the positive pressure is relieved from the outer bellows assembly 52 and a vacuum is instead applied. The outer housing flange 26 and the lower ring flange 60 come out of contact with each other and the retaining ring 62 is raised so that the downward side 6 of the wafer 4 protrudes downwardly past the retaining ring 62.

The amount the downward side 6 of the wafer protrudes past the retaining ring 64 is also known as wafer reveal. The maximum amount of wafer reveal is preferably defined by the amount the downward side 6 of the wafer 4 protrudes past the retaining ring 62 when the retaining ring 62 is in the fully raised position, i.e., when the outer bellows assembly 52 is fully contracted. Placing shims 64 such as Mylar shims above the retaining ring 62 will vary the maximum amount of wafer reveal. Applying positive pressure and/or vacuum forces to the outer bellows assembly 52 during the polishing process changes the position of the retaining ring 62, which in turn allows the amount of wafer reveal to be variable.

By applying a positive pressure to inner bellows assembly 80, a uniform downward force is applied to the entire wafer 4 during the polishing cycle because the mean diameter of the inner bellows assembly 80 is substantially the same as the diameter of the wafer 4. The mean diameter of the inner bellows assembly 80 is the average between the outer diameter of the inner bellows assembly 80 and the inner diameter of inner bellows assembly 80, and the mean diameter is the effective area on which the positive pressure acts. The bottom surface 87 of the inner ring 84, with the outer side 96 of the membrane 90 covering it, applies the same downward force to the outer part 12 of the upward side 10 of the wafer 4 as is applied to the balance of the wafer 4 by the balance of the membrane 90. Because the same downward force is applied to the entire wafer 4, a uniform polishing action is applied to the entire downward side 6 of the wafer 4.

During the polishing cycle the wafer carrier head 2 is capable of gimballing. Because of their flexible nature, the inner bellows assembly 80 and the outer bellows assembly 52 can accommodate changes in parallelism between the wafer carrier head 2 and the polishing surface 18. The distance between the upper flange 30 and the inner ring flange 88 during the polishing cycle and the distance between the outer housing flange 26 and the lower ring flange 60 during the polishing cycle define the wafer carrier head gimbal allowance.

Referring to FIG. 5, once the polishing cycle is completed, the wafer unload sequence begins. A vacuum is introduced to the inner port 46. The vacuum is introduced into the inner port chamber 66 and via the lower passages 78 travels into the gap 92. The vacuum causes the inner bellows assembly 80 to contract and exerts an upward force on the inner ring 84. As shown in FIG. 4, this causes the inner ring flange 88 to contact the upper flange 30 on the inner housing 22. The vacuum in the gap 92 deforms the membrane 90 and draws it up and against the downwardly facing wall 24 of the inner housing, thus eliminating the gap 92.

Since the outer part 12 of the wafer 4 is sealed against the membrane 90, the secondary vacuum 102 results between the remainder of the membrane 90 and the remainder of the wafer 4, holding the wafer 4 in place. The secondary vacuum 102 draws up the wafer 4 so that the retaining ring 62 protrudes downwardly past the wafer 4. The wafer carrier head 2 is then transported to an unload station.

As shown in FIG. 3, the wafer handling mechanism 16 is brought up adjacent to the retaining ring 62 and is raised to contact and apply an upward force to the wafer 4. A positive pressure is then introduced at the inner port 46 and into the inner port chamber 66. Via the side passage 76, the positive pressure travels into the inner bellows assembly 80. The positive pressure also travels through the lower passages 78 and eliminates the secondary vacuum 102. The upward force applied by the wafer handling mechanism prevents the membrane 90 from returning to its non-deformed state.

Referring to FIG. 2, the wafer handling mechanism 16 is lowered away from the wafer 4. As the wafer handling mechanism 16 is lowered, the now unrestrained membrane 90 is able to return to its non-deformed state and expels the wafer 4 from the wafer carrier head 2 and onto the wafer handling mechanism 16. The wafer carrier head 2 is now ready to repeat the above-described method to accept a new wafer for polishing.

The advantages of the above-described embodiments of the invention are numerous. For example, having a uniform downward force applied to the entire wafer 4 minimizes the problem of edge exclusion. Edge exclusion occurs when the outer part 8 of the wafer 4 does not receive the same degree of polishing action as the balance of the wafer 4. The result is a reduction of usable area for production that is made available. The wafer carrier head herein described minimizes edge exclusion by applying the same down force to the outer part 8 of the wafer 4 as is being applied to the remainder of the wafer 4.

Another advantage is the elimination of polishing slurry entering into the lower passages 78 of the carrier head 4. Because the membrane 90 seals the lower passages 78 from the slurry, the slurry is unable to enter into the wafer carrier head 2.

Employing an adjustable wafer retaining ring 62 also minimizes the chances of having the wafer 4 slip out from under the wafer carrier head 2. The retaining ring 62 is adjusted by applying positive pressure and vacuum forces to the outer bellows assembly 52. Adjusting the amount the retaining ring 62 protrudes from the lower ring 56 prevents the wafer 4 from extending beyond the retaining ring 62 when the inner bellows assembly 80 is applying a positive pressure to the wafer 4 to lower it onto the polishing surface 18. By employing an adjustable wafer retaining ring, the timing between lowering the retaining ring 62 to the polishing surface 18 and applying pressure at the inner bellows assembly 80 to the membrane 90 to lower the wafer 4 onto the polishing surface 18 is not critical.

Another advantage of the present embodiments is the elimination of a mechanical gimbal point, which in turn will eliminate any resultant moment arm because the effective gimbal point will be located at the wafer 4. Eliminating the moment arm will reduce the amount the carrier head 2 will tend to dig into the outer part 12 of the wafer 4. This problem is common to wafer carrier heads 2 and causes a higher rate of wafer removal to occur at the outer part 8 of the wafer 4 than the remainder of the wafer 4. The amount the carrier head 2 digs into the wafer 4 is directly proportionate to the length of the moment arm. The present embodiments minimize this amount because the lack of a mechanical gimbal point means that there is no moment arm associated with the present invention.

The embodiments of the wafer carrier head herein described also employ components made up of high-strength plastics. In preferred embodiments of the invention, the outer housing, inner housing, inner housing chamber and the retaining ring can be made from high-strength plastics. This provides the added advantage of reducing the overall weight of the wafer carrier head.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A wafer carrier head comprising:

a primary housing having an adjustable retaining ring, said retaining ring protruding downwardly from said primary housing;

a secondary housing fixed to said primary housing having a wafer holding mechanism positioned in an area surrounding the circumference of said retaining ring, said wafer holding mechanism including a flexible membrane configured to hold a wafer, a seal defined by a downwardly facing outer edge of said membrane and a corresponding outer edge of said wafer, wherein said wafer holding mechanism retains and transports said wafer through the exclusive application of retaining forces on an upper surface of said wafer and retains a downwardly facing surface of said wafer on said polishing surface through the application of pressure forces, said seal and one of said retaining forces being configured to create a secondary retaining force between a remainder of said membrane and a remainder of an upper surface of said wafer not in contact with each other;

and wherein said retaining ring is movable with respect to said primary housing, and movable independent of said wafer holding mechanism, and retains an edge of said wafer on a polishing surface when said wafer is lowered onto said polishing surface.

2. The wafer carrier head of claim 1, wherein said retaining ring is upwardly and downwardly moveable and adjustable through the application of a pressure.

3. The wafer carrier head of claim 2, wherein an initial position of said retaining ring is adjustable through placement of at least one shim between said primary housing and said wafer retaining ring.

4. The wafer carrier head of claim 2, wherein said retaining ring comprises a plastic material.

5. The wafer carrier head of claim 2, wherein said pressure is applied to said retaining ring through a primary bellows assembly attached to said retaining ring.

6. The wafer carrier head of claim 5, wherein said primary bellows assembly comprises metal.

7. The wafer carrier head of claim 6, wherein said primary bellows assembly further comprises welded metal.

8. The wafer carrier head of claim 1, wherein said pressure forces and said retaining forces are adjustable.

9. The wafer carrier head of claim 1, wherein said primary housing further comprises at least one primary housing stop and said retaining ring mechanism has at least one retaining ring stop, said primary housing stop and said retaining ring stop entering into and out of contact with each other to limit vertical motion of said retaining ring.

10. A wafer carrier head comprising:

a primary housing having an adjustable wafer retaining mechanism configured to retain an outer edge of a wafer on a polishing surface when said wafer is being lowered onto said polishing surface;

a secondary housing fixed to said primary housing, said secondary housing having an adjustable wafer holding mechanism configured to apply one of a downward force and an upward force to an upper surface of said wafer and to retain and transport said wafer to and from said polishing surface and to retain said wafer on said polishing surface, said wafer holding mechanism including a flexible membrane to hold said wafer, and a seal defined by a downwardly facing outer edge of said membrane and a corresponding outer edge of said wafer;

wherein said wafer holding mechanism retains and transports said wafer through the exclusive application of retaining forces and wherein said seal and said upward force cause a secondary upward force to be applied between a remainder of said membrane and a corresponding remainder of an upper surface of said wafer.

11. The wafer carrier head of claim 10, wherein said wafer holding mechanism further comprises a bellows assembly having a downwardly facing surface attached to an inner ring, said inner ring in contact with an upwardly facing outer edge of said membrane, said bellows assembly providing one of said downward force and said upward force onto said seal, and a chamber defined by an interior surface of said secondary housing, said chamber providing said downward force to said remainder of said membrane and said corresponding remainder of said wafer, and said upward force to said remainder of said membrane, said bellows assembly and said chamber together providing said uniform downward force to said membrane and said wafer.

12. The wafer carrier head of claim 11 wherein said chamber communicates said downward force and said upward force to said bellows assembly and to said remainder of said membrane.

13. The wafer carrier head of claim 12 wherein said bellows assembly comprises metal.

14. The wafer carrier head of claim 13, said bellows assembly further comprises welded metal.

15. The wafer holding mechanism of claim 11, wherein one of said housing and said bellows assembly further comprises at least one first stop and the other of said secondary housing and said secondary bellows assembly further comprises at least two second stops, said first stop entering into and out of contact with one of said second stops to limit motion of said wafer holding mechanism in one direction and the other of said second stops to limit motion of said wafer holding mechanism in an opposite direction.

16. The wafer holding mechanism of claim 15 wherein said secondary housing includes said first stop and said bellows assembly includes said secondary stops.

17. The wafer holding mechanism of claim 15 wherein said bellows assembly includes said first stop and said secondary housing includes said secondary stops.

18. The wafer carrier head of claim 10, wherein said downward force applied by said wafer holding mechanism on said wafer is adjustable and controllable, and whereby said wafer is uniformly polished when said wafer holding mechanism is retaining said wafer on said polishing surface.

19. A wafer carrier head comprising:

a primary housing having a vertically adjustable wafer retaining mechanism to retain an outer edge of a wafer on a polishing surface when said wafer is being lowered onto said polishing surface, said wafer retaining mechanism including a flexible primary bellows assembly;

a secondary housing fixed to said primary housing having a vertically adjustable wafer holding mechanism to retain and transport a wafer to and from a polishing surface and to retain said wafer on said polishing surface, said wafer retaining mechanism including a flexible secondary bellows assembly;

wherein said primary bellows assembly and said secondary bellows assembly together allow said wafer carrier head to pivot, and wherein said wafer retaining mechanism and said wafer holding mechanism are configured to pivotally accommodate changes in parallelism between said wafer and said polishing surface when said wafer is being polished by said polishing surface.

20. The wafer carrier head of claim 19, wherein said primary housing further comprises at least one primary housing stop and said wafer retaining mechanism comprises at least one wafer retaining stop, said primary housing stop and said wafer retaining stop positioned to enter into and out of contact with each other to limit motion of said wafer retaining mechanism, and wherein said secondary housing further comprises at least one secondary housing stop and said wafer holding mechanism has at least one holding mechanism stop, said secondary housing stop and said wafer retaining stop positioned to enter into and out of contact with each other to limit motion of said wafer holding mechanism.

21. The wafer carrying head of claim 20, wherein an amount said wafer carrier head can pivot is limited by a distance between said primary housing stop and said wafer retaining stop and by a distance between said secondary housing stop and said holding mechanism stop.

* * * * *

UNITED STATES PATENT AND TRADEMARK OFFICE

CERTIFICATE OF CORRECTION

PATENT NO. : 6,666,756 B1
DATED : December 23, 2003
INVENTOR(S) : Glenn W. Travis It is certified that error appears in the above-identified patent and that said Letters Patent is hereby corrected as shown below:

Title page,
Item [57], ABSTRACT,
Line 2, delete "dis;losed" and substitute -- disclosed -- in its place.

Signed and Sealed this

Eighteenth Day of January, 2005

JON W. DUDAS
*Director of the United States Patent and Trademark Office*